US008763554B2

(12) United States Patent
Porter

(10) Patent No.: US 8,763,554 B2
(45) Date of Patent: Jul. 1, 2014

(54) METHOD AND APPARATUS FOR SPRAY PAINTING SOIL OF A GOLF HOLE

(75) Inventor: Robert E. Porter, Topanga, CA (US)

(73) Assignee: White Metal Golf, Topanga, CA (US)

( * ) Notice: Subject to any disclaimer, the term of this patent is extended or adjusted under 35 U.S.C. 154(b) by 110 days.

(21) Appl. No.: 13/145,988

(22) PCT Filed: Jan. 27, 2010

(86) PCT No.: PCT/US2010/022252

§ 371 (c)(1),
(2), (4) Date: Sep. 13, 2011

(87) PCT Pub. No.: WO2010/088284

PCT Pub. Date: Aug. 5, 2010

(65) Prior Publication Data

US 2012/0024981 A1 Feb. 2, 2012

Related U.S. Application Data

(60) Provisional application No. 61/206,033, filed on Jan. 27, 2009.

(51) Int. Cl.
*B05C 5/00* (2006.01)
*B05D 7/22* (2006.01)

(52) U.S. Cl.
USPC ..... 118/317; 118/504; 427/230; 427/236; 473/175; 473/195; 239/225.1; 239/264; 239/302

(58) Field of Classification Search
USPC ..... 427/230, 236; 118/317, 504; 473/175, 473/195; 239/255.1, 264, 302, 225.1
See application file for complete search history.

(56) References Cited

U.S. PATENT DOCUMENTS

| | | | | |
|---|---|---|---|---|
| 3,737,108 | A * | 6/1973 | Stumphauzer et al. | 239/598 |
| 4,797,305 | A * | 1/1989 | Schleicher | 427/236 |
| 6,455,104 | B1 * | 9/2002 | Kirwan | 427/236 |
| 8,272,580 | B1 * | 9/2012 | Schoppe | 239/337 |
| 2008/0296407 | A1 * | 12/2008 | Schleicher | 239/302 |
| 2009/0039179 | A1 * | 2/2009 | Kado et al. | 239/225.1 |

* cited by examiner

*Primary Examiner* — William Phillip Fletcher, III
(74) *Attorney, Agent, or Firm* — Rutan & Tucker LLP; Hani Z. Sayed

(57) ABSTRACT

Systems and methods for painting, which might be used to paint the soil in a golf hole are provided. A spraying device can comprise a first masking apparatus, a second masking apparatus coupled to the first and a paint dispersing device, between the first and second masking apparatus. The paint may disperse from a single nozzle that can include multiple individual exit points for the spray. In another embodiment, the single nozzle includes an exit point and a flat or curved plate to direct the spray. Alternatively, the paint dispersing apparatus may comprise multiple nozzles. The nozzles may be provided with paint using tubes connecting from a paint source, such as an aerosol paint can, to each nozzle. The first masking apparatus can be a golf cup mask and the second masking apparatus can be a putting green mask.

14 Claims, 7 Drawing Sheets

METHOD AND APPARATUS FOR SPRAY PAINTING SOIL OF A GOLF HOLE

CROSS REFERENCE TO RELATED APPLICATIONS

This application claims the earlier benefit of U.S. PCT Patent Application No. PCT/US2010/022252 entitled "Spraying Apparatus and Methods of Doing Same", filed on Jan. 27, 2010 and U.S. Provisional Patent Application Ser. No. 61/206,033 entitled "Spraying Apparatus," filed Jan. 27, 2009.

FIELD

The present invention generally relates to a system and method for painting. More specifically, the present invention relates to a system and method that may be used to paint the inside of a recessed cavity, for example, a golf hole.

BACKGROUND

It is often the case that golfers and golf course superintendents prefer that a hole on a golf course be colored white such that the hole is more visible and easily distinguished from the familiar green to assist the individual golfer with putting. Because the golf cup needs to be set into the golf hole at least one inch below the surface of the green according to the rules of golf, it is often necessary for golf course superintendents to paint the soil surrounding the cup in order to distinguish it from the surrounding green and provide a visible target for the golfers. A method currently used for coloring the soil is to spray paint the soil. A paint brush would be problematic because it would likely become clogged with dirt, sand, or other debris. However, a problem with spray paint is that it can adversely affect the grass of the green or potentially spray onto or drip into the cup.

Additionally, some current systems require a user to activate a spray canister and rotate it relative to the golf hole, which requires the simultaneous application of force in multiple directions to push down and activate the aerosol spray canister while simultaneously twisting the spray canister or the apparatus which holds the canister in a full 360 degree arc. This can be difficult and lead to irregular spray patterns or excess paint build-up, leaving an unattractive, uneven residue in the golf hole. Another problem is that prior art systems do not prevent paint from collecting on the golf cup, which builds up over time and leads to premature denigration of the cup. Also, the current system includes multiple supports which cross the soil to be painted in order to provide a coupling means between the golf green support area and the activation mechanism, which is located in the center of the golf hole. These support beams prevent paint from being sprayed onto the soil where they depend from the green into the hole, so the user needs to rotate the entire device after applying the first coat, and start the entire process over again and paint a full 360 degree radius.

Another commonly used solution does not include the utilization of paint. Rather, a plastic sleeve is inserted into the golf hole and sits inside the cup and is typically colored white prior to insertion into the hole. This sleeve can slide upward upon removal of the flag pole and thus prevent golf balls from rolling into the cup. However, these plastic sleeves do not comply with the common rules of golf

SUMMARY

Various embodiments of the systems and methods described herein are related to painting and more particularly, to systems and methods that might be used to paint the inside of a recessed cavity, for example, a golf hole. To this end, in an exemplary embodiment of the present invention, a paint spraying device that includes a first masking apparatus and a second masking apparatus are disclosed. The second masking apparatus may be located above the first masking apparatus and a paint spraying apparatus device may be located between the first and second masking apparatus. Additionally, the paint spraying apparatus device may be coupled to the first and second masking apparatus to provide a paint spray that can coat the soil in a golf hole located anywhere on a golf course.

To this end in an exemplary embodiment of the present invention, a paint spraying device is provided. The paint spraying device has a first masking apparatus and a second masking apparatus. Additionally, the paint spraying device has a paint dispensing portion, located between the first and second masking apparatus, wherein the dispensing portion provides a paint spray and further wherein the dispensing portion is coupled to the first and second masking apparatus.

In an exemplary embodiment, the spraying device may simultaneously sprays a full 360 degree radius.

In an exemplary embodiment the paint spraying device may have a single nozzle that includes multiple individual exit points for the spray.

In an exemplary embodiment the paint spraying device may include a plate that is curved to decrease the thickness of the paint spray.

In an exemplary embodiment the paint spraying device may have a paint dispensing portion that comprises at least a nozzle that provides a hemispherical paint stream.

In an exemplary embodiment the paint spraying device may have a nozzle whereby the nozzle is provided with paint using tubes connecting from a paint source to the nozzle.

In an exemplary embodiment the paint spraying device may have an aerosol paint can coupled to the paint dispersing portion.

In an exemplary embodiment the paint spraying device may have a first masking apparatus which comprises a golf cup mask, and the second masking apparatus which comprises a putting green mask.

In an exemplary embodiment the paint spraying device may have a spraying apparatus which rotates relative to the golf hole.

To this end, in another exemplary embodiment of the present invention, a method of painting is provided. The method comprises the steps of: placing a first masking apparatus inside a hole on a golf course to block paint from collecting on the golf cup; placing a second masking apparatus over the hole on a golf course to block paint from collecting on a green on a golf course; locating a paint spraying apparatus between the first and second masking apparatus; and simultaneously painting all of the soil in the hole between the first and second masking apparatus.

In an exemplary embodiment, the method comprises the step of: the first masking apparatus comprising a golf cup mask, and the second masking apparatus comprising a putting green mask.

In an exemplary embodiment, the method comprises the step of: using at least a nozzle as a paint spraying apparatus.

In an exemplary embodiment, the method comprises the step of: rotating the paint dispensing apparatus relative to the hole.

In an exemplary embodiment, the method comprises the step of: providing an aerosol spray can and connecting the aerosol spray can to the paint dispensing apparatus.

In an exemplary embodiment, the method comprises the step of: providing a nozzle including a plate to deflect a spray of paint, wherein the plate is curved.

To this end, in an exemplary embodiment of the present invention, a paint spraying device for painting the soil of a golf hole is provided. The device has a first masking apparatus and a second masking apparatus. Additionally, the device has a paint spraying portion having unobstructed access to adjacent soil to be painted, configured between the first and second masking apparatus whereby the paint spraying portion is in communication with the soil to be painted.

In an exemplary embodiment, the device has a paint dispensing portion that rotates relative to the first and second masking apparatus.

In an exemplary embodiment, the device has a first masking apparatus which is a golf cup mask, and the second masking apparatus which is a golf green mask.

In an exemplary embodiment, the device has a paint spraying portion that may spray in multiple directions simultaneously and wherein the paint spraying apparatus may spray in a 360 degree radius simultaneously.

In an exemplary embodiment, the device has a paint spraying portion that may rotate relative to the golf hole.

In one embodiment the paint spraying apparatus comprises at least a nozzle. The nozzle may comprise multiple individual exit points for the spray or, alternatively, the single nozzle may comprise an exit point and at least a plate to direct the spray. The plate may be flat to allow for a thick spray, or in the alternative may be angled out to allow for an even thicker spray. Additionally, the plate may be angled inward to provide for a thinner spray or in an exemplary embodiment, may be curved inward or outward to direct the paint spray. In another exemplary embodiment, the paint dispensing apparatus comprises at least a nozzle that provides a hemispherical paint stream.

In an exemplary embodiment, it is contemplated that the paint dispersing apparatus may comprise a plurality of nozzles. The nozzles may be provided with paint using tubes connecting from a paint source to each nozzle. Example paint sources include aerosol paint cans that may be coupled to the paint dispersing device. In various embodiments, the first masking apparatus may be a golf cup mask and the second masking apparatus may be a putting green mask.

Some embodiments further include a method of painting a soil, the method comprising the steps of placing a first masking apparatus inside a hole on a golf course to block paint from collecting on the golf cup and placing a second masking apparatus over the hole on a golf course to block paint from collecting on a green on a golf course. A paint spraying apparatus may be located between the first and second masking apparatus. The paint spraying apparatus may be used to paint the soil in a hole at a golf course Further features and advantages of the presently disclosed method and apparatus, as well as the structure and operation of various embodiments of the presently disclosed method and apparatus, are described in detail below with reference to the accompanying drawings.

BRIEF DESCRIPTION OF THE DRAWINGS

The disclosed method and apparatus is described in detail with reference to the following figures. The drawings are provided for purposes of illustration only and merely depict typical or example embodiments of the disclosed method and apparatus. These drawings are provided to facilitate the reader's understanding of the disclosed method and apparatus and are not to be considered as limitations of the breadth, scope, or applicability of the claimed invention. The appended claims should be reviewed to determine the breadth, scope and applicability of the claimed invention. It should be noted that for clarity and ease of illustration, these drawings are not necessarily made to scale.

It should be understood that the disclosed method and apparatus might be practiced with modification and alteration.

DETAILED DESCRIPTION

Figure 1:
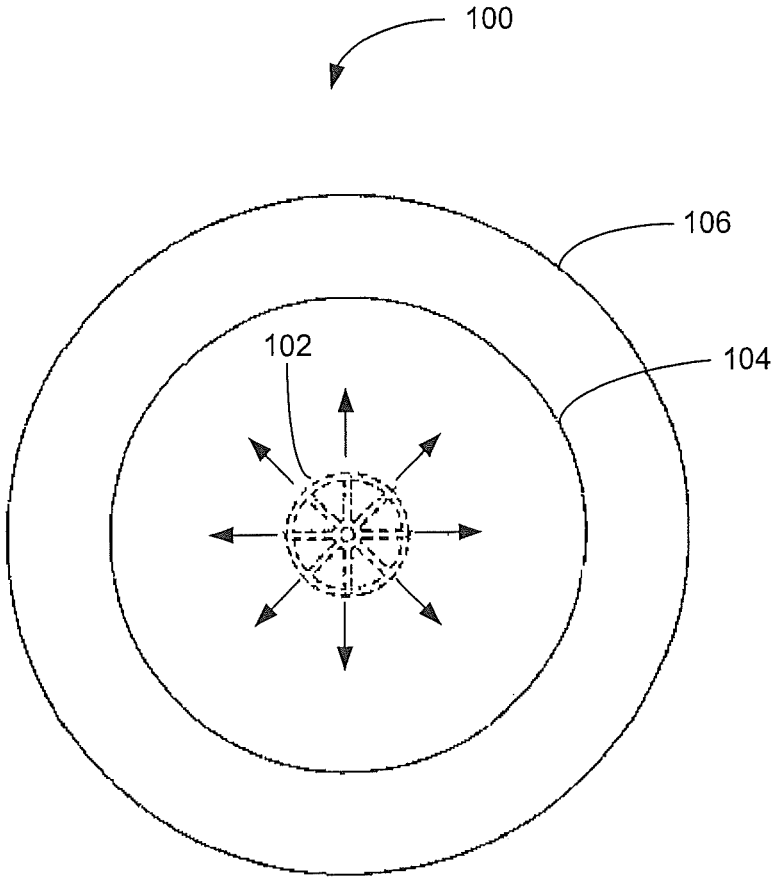
FIG. 1 is a diagram illustrating an above pan view of an exemplary embodiment of the spraying apparatus containing a putting green mask, a golf cup mask, and a spray nozzle.

FIG. 1 is a diagram illustrating an above pan view of an example spraying apparatus 100 containing a putting green mask 106, a golf cup mask 104, and a spray nozzle 102. In some embodiments the nozzle 102 can be apportioned within slots on the putting green mask. As illustrated in FIG. 1, the spray nozzle 102 may spray in multiple directions. For example, the spray nozzle 102 might emit a 360 degree stream of paint spray. The stream of paint can be angled such that it is approximately as thick as the height of an area of soil in a hole to be painted. Alternatively, the stream of paint emitted might be as thick as an area of soil in a hole to be painted or some combination of stream angle and initial stream thickness may be used. Regardless of the thickness and angles used, the golf cup mask 104 and the putting green mask 106 would generally block paint from getting on the golf cup and the putting green, respectively.

In some embodiments, the spray nozzle 102 might emit a hemispherical paint spray. With such a nozzle 102 the soil would be painted while the golf cup mask 104 and the putting green mask 106 would generally block paint from getting on the golf cup and the putting green, respectively. A large amount of paint might be deposited on the masks 104 and 106, however, this might waste a large amount of paint.

Additionally, while the illustrated embodiment includes a 360 degree stream of paint, it will be understood by those of skill in the art that spray nozzles that spray at angles less than 360 degrees may be used. A device using such a nozzle would require rotation of the spraying apparatus to paint all of the soil.

In another embodiment multiple spray nozzles might be used. The multiple spray nozzles may take the place of a single nozzle 102 and may also point in various directions in order to spray through a full 360 degree angle around the inside of a golf hole when activated.

Figure 2:
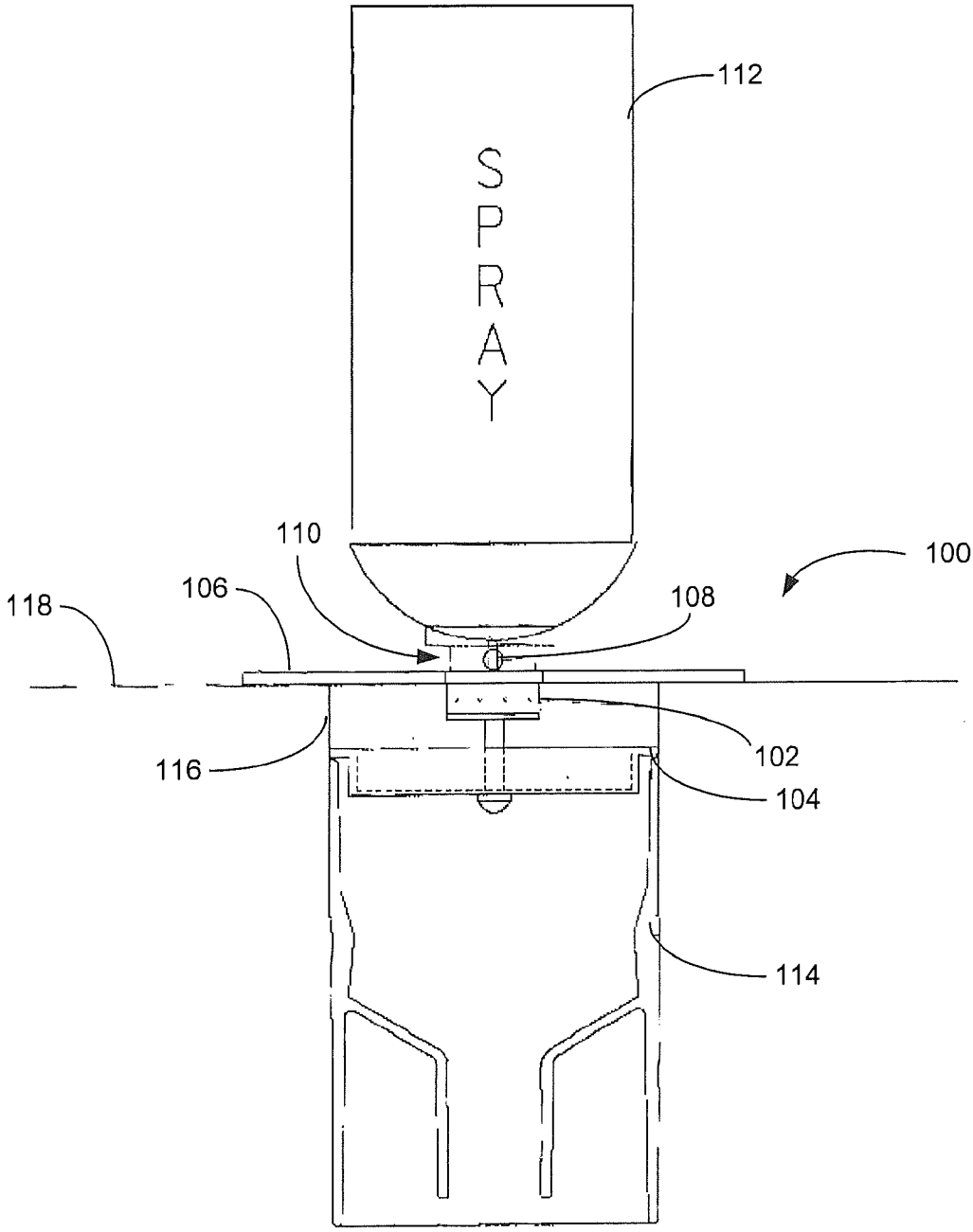
FIG. 2 is a block diagram illustrating a side view of an exemplary embodiment of the spraying apparatus connected to an aerosol spray canister.

FIG. 2 is a diagram illustrating a side view of the example spraying apparatus 100 attached to an aerosol spray paint canister 112. The spraying apparatus 100 illustrated includes the golf cup mask 104 in a spray position to generally prevent the spray nozzle 102 from spraying the golf cup 114. The golf cup mask 104 may also be placed in the shield position to cover the nozzles and prevent the spray nozzle 102 from spraying a user when clearing the nozzle after use.

The spraying apparatus 100 illustrated also includes putting green mask 106. The putting green mask 106 may prevent spray or overspray from hitting the putting green 118.

As illustrated in FIG. 2 an aerosol spray canister 112 may be connected to the spraying apparatus 100 via a spray canister connection 110. As discussed above, the putting green 118 may be protected from overspray by the putting green mask 106 while the golf cup 114 may be protected by the golf cup mask 104. In some embodiments, the golf cup mask 104 may be bowl shaped to collects excess paint that might drop onto or be sprayed onto it from the nozzle 102. Soil 116 may then be painted white by activating the spray canister 112 via an activation opening 108. All of the soil 116 above the golf cup 114 might be painted simultaneously by the spray nozzle 102 which may cover 360 degrees around the hole. Additionally, the paint stream can be as thick as the soil area 116 such that the entire soil area 116 is painted. The user can also rotate the spraying apparatus within the slots in order to provide a more even coating to the soil 116 if needed. (It will be understood that, while the golf hole is surrounded by soil, much of this soil is blocked by the cup. Soil 116 refers to the top portion of soil that is generally just below the green and just above the cup.)

Figure 3:
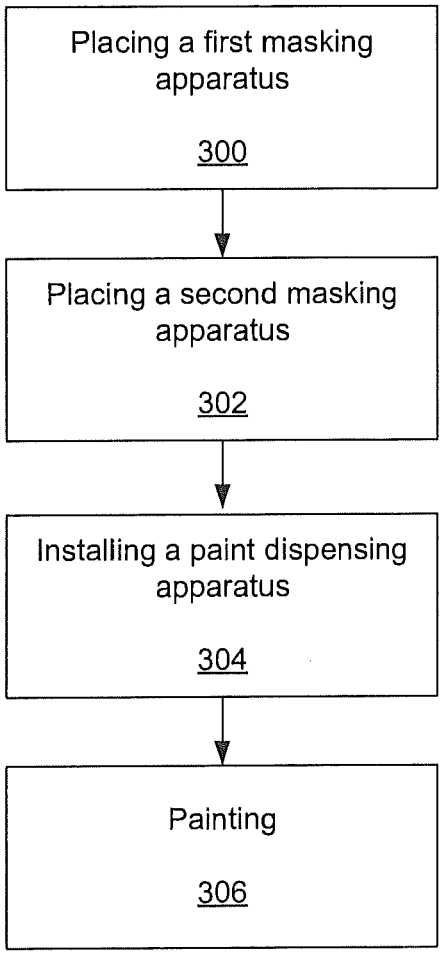
FIG. 3 is a flow diagram illustrating the method in accordance with an exemplary embodiment of the present invention.

FIG. 3 is a flow diagram illustrating an example method in accordance with one embodiment of the systems and methods described herein. In step 300 a first masking apparatus is placed inside a golf hole to block or prevent paint from collecting on the golf cup. The first masking apparatus may be the same or similar to the golf cup mask 104 and can include a bowl shape to collect paint overspray.

In step 302 a second masking apparatus is placed over the golf hole to block or prevent paint from collecting on the golf green. The second masking apparatus may be the same or similar to the putting green mask 106.

In step 304 a paint spraying apparatus may be located between the first and second masking apparatus. For example, the paint spraying apparatus can be a nozzle 102 or multiple nozzles. The nozzle 102 or nozzles may be configured to dispense paint in multiple directions simultaneously. For example, as discussed above, the nozzle(s) may spray 360 degrees to a thickness of the soil 116 in a hole on a golf course.

In step 306 the soil is painted by spraying paint from the nozzle(s). The paint may be provided by an aerosol spray canister or other paint storage device. The soil 116 around the top of the hole can be painted 360 degrees at a time or, in some embodiments, the device used might be rotated to provide paint to the soil 116.

Figure 4:
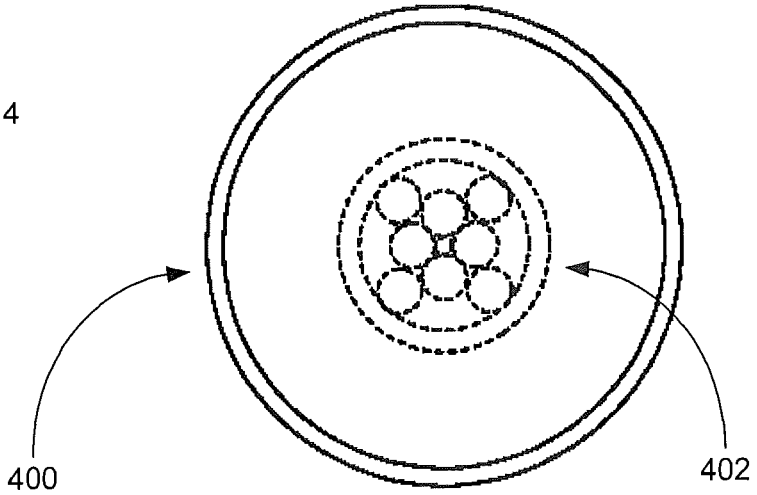
FIG. 4 is a diagram illustrating an above pan view of another exemplary embodiment of the spraying apparatus including multiple spray nozzles apportioned within slots on the putting green mask.

FIG. 4 is a diagram illustrating an above pan view of another example spraying apparatus 400 including multiple spray nozzles 402 that may be apportioned within slots on the putting green mask 404. In the illustrated embodiment eight spray nozzles 402 are used. Each nozzle 402 might cover approximately 45 degrees, however, it is also possible that a paint stream from the nozzles 402 might overlap.

Figure 5:
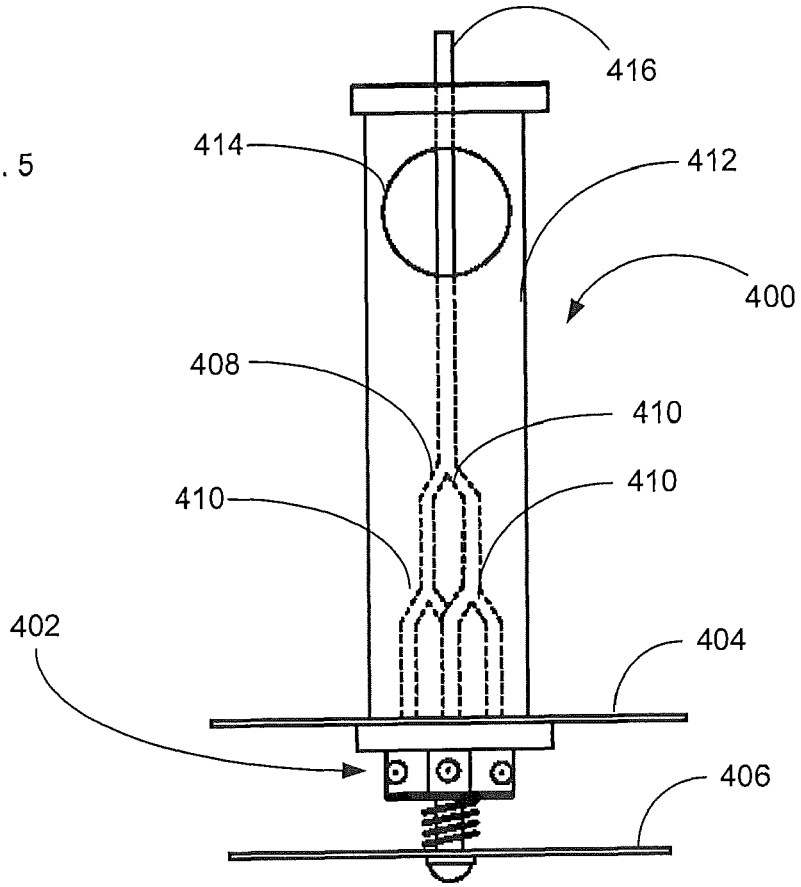
FIG. 5 is a diagram illustrating a side view of the spraying apparatus in an exemplary embodiment illustrating the spraying apparatus of FIG. 4.

FIG. 5 is a diagram illustrating a side view of the example spraying apparatus 400 of FIG. 4. The apparatus 400 includes nozzles 402, a putting green mask 404, and a golf cup mask 406. The spray nozzles 402 may be seated within slots on the putting green mask 404 and held in place by a nozzle clamp which abuts the axis to allow the golf cup mask 406 to slide into the shield position when help upright. Tubing 408 is used to provide paint between a paint source and the nozzles 402. The tubing 408 can be split into different branches using Y connectors 410. In this way a single paint source might provide paint to multiple nozzles. The tubing 408 can be contained in the tubular housing 412 which may include an activation opening 414 which provides access to the tubing 408. In the illustrated embodiment, the tubing 408 terminates at the hose connection 416 which may fasten to an aerosol spray canister outlet valve.

Figure 6:
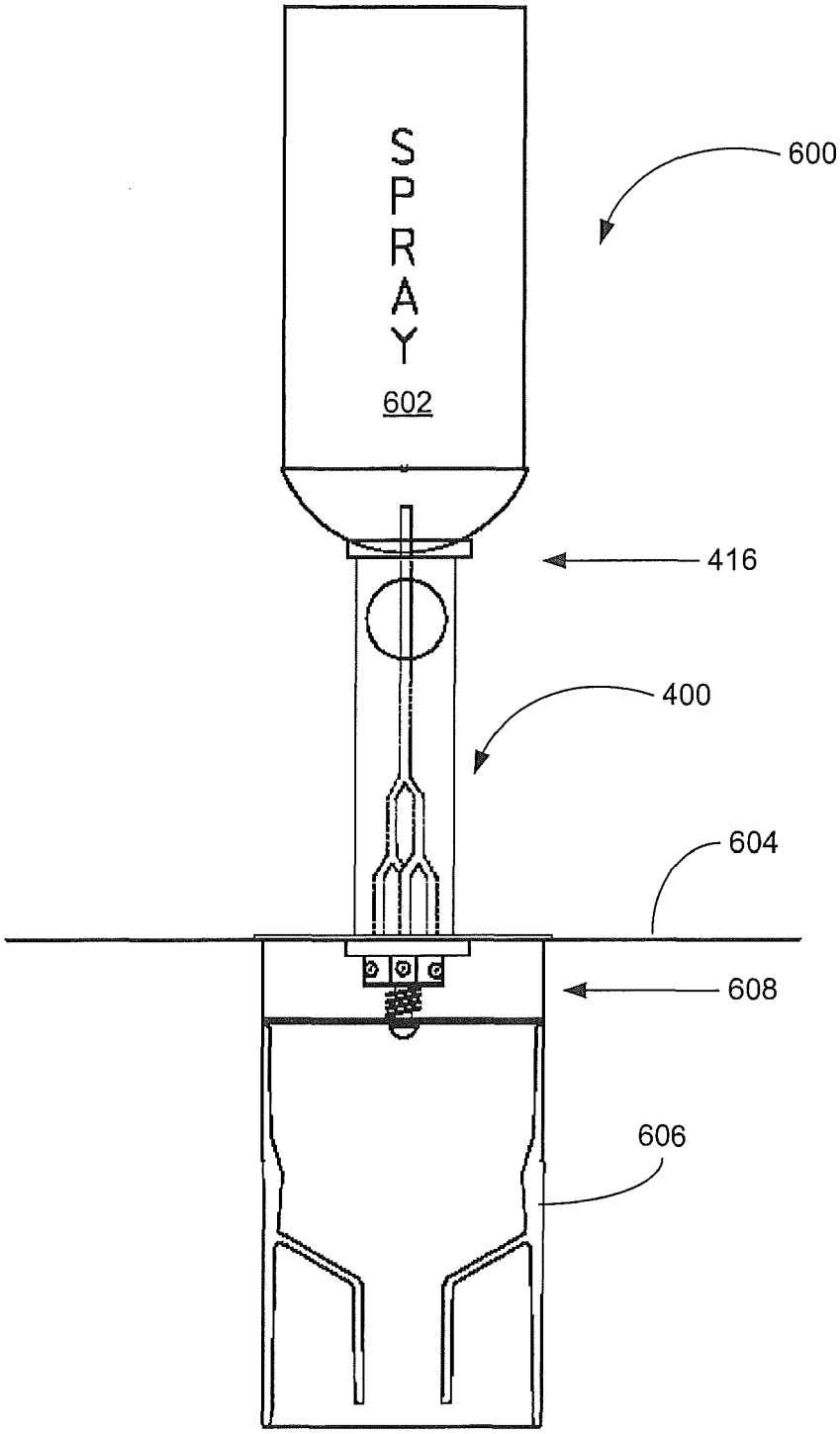
FIG. 6 is a block diagram illustrating a side view of the spraying apparatus in an exemplary embodiment illustrated in FIGS. 4-5.

FIG. 6 is a block diagram illustrating a side view of the example spraying apparatus of FIGS. 4-5. As illustrated in FIG. 6 an aerosol spray canister 602 may be connected to the spraying apparatus 400 via the spray canister connection 416. The putting green 604 can be protected from overspray by the putting green mask 404 while the golf cup 606 can be protected by the golf cup mask 406. The golf cup mask 406 may have a bowl shape that can collect excess paint. The soil 608 may then be painted white by activating the spray canister 602 via the activation opening 414. All of the soil above the golf cup 606 might be painted simultaneously by the multiple spray nozzles 402 which may cover 360 degrees and provide a paint stream that is as thick as the soil area 608. The user can also rotate the spraying apparatus within the slots in order to provide a more even coating to the soil 608 if necessary.

Figure 7:
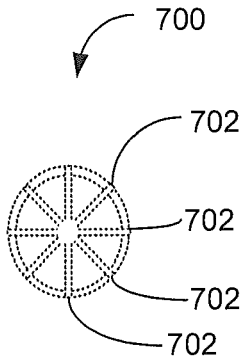
FIG. 7 is a diagram illustrating a nozzle in an exemplary embodiment of the present invention.

Many different types of nozzles might be used in conjunction with the systems and methods described herein. For example, as illustrated in FIG. 7, a single nozzle 700 with multiple individual exit points 702 may be used. The multiple individual exit points may direct the paint over a small portion of the 360 degree band of soil that forms the top area of the golf hole. As an example, if 8 individual exit points are used each might cover approximately 45 degrees. It will be understood that some overlap may be provided such that each of the individual exit points used might cover more than 45 degrees.

Figure 8:
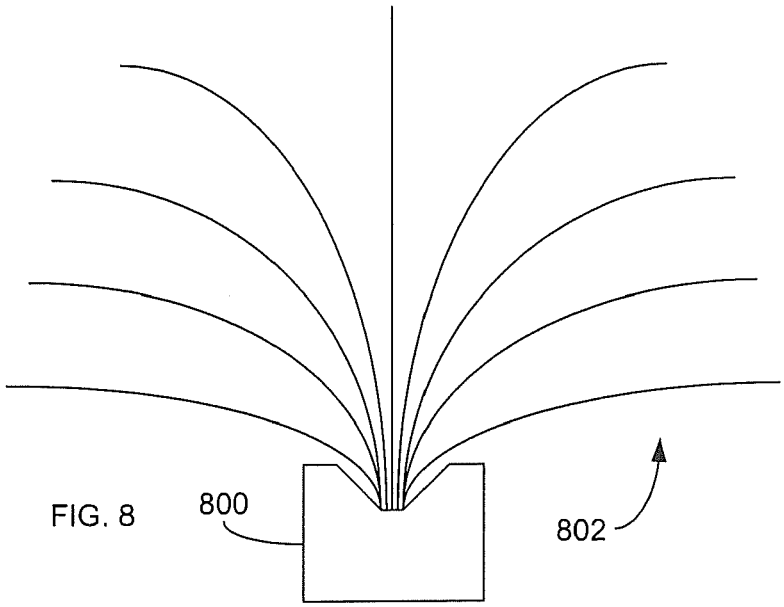
FIG. 8 is a diagram illustrating a nozzle in an exemplary embodiment of the present invention.

A nozzle 800 that sprays in a hemispherical stream 802 may also be used, as illustrated in FIG. 8. Such a nozzle might, however, generate a large amount of overspray. This overspray might be collected on the masks so that it does not color the green or the cup.

Figure 9:
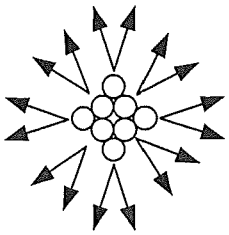
FIG. 9 is a diagram illustrating a plurality of nozzles in an exemplary embodiment of the present invention.

FIG. 9 illustrates an example system using multiple nozzles to form a 360 degree stream of paint. In a multiple nozzle system each nozzle might include a separate paint source, such as a tube that conveys the paint from, e.g., an aerosol spray paint can to the nozzle. For example, a single tube might exit the can and then be split into multiple tubes which then connect to the multiple nozzles.

Figure 10:
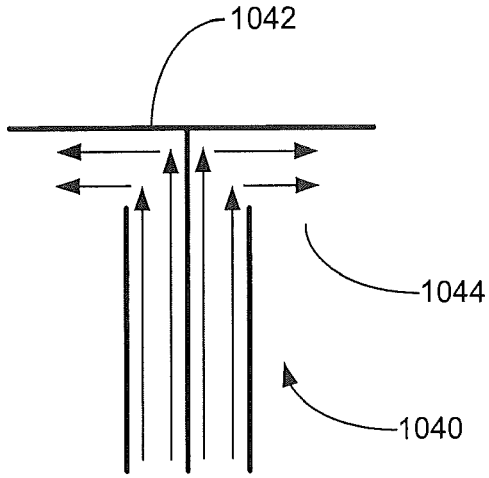
FIG. 10 is a diagram illustrating a nozzle in an exemplary embodiment of the present invention.

FIG. 10 illustrates an example nozzle 1040 that includes a plate 1042 to direct a paint spray 1044. In some embodiments, the plate may be connected to the rest of the nozzle using a rod in the middle of the spray. Accordingly, the support will not block paint from being directed across the full 360 degrees. The plate 1042 may be flat to allow paint to be directed a full 360 degrees. Alternatively, the plate may be shaped to direct paint at angles less than 360 degrees.

Figure 11A:
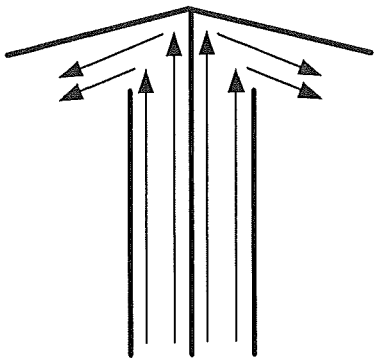
FIGS. 11A-B are diagrams illustrating a plurality of nozzles in an exemplary embodiment of the present invention.
Figure 11B:
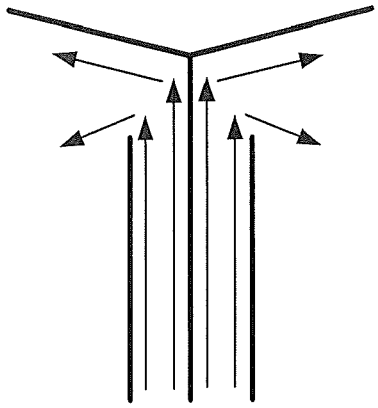
Figure 12A:
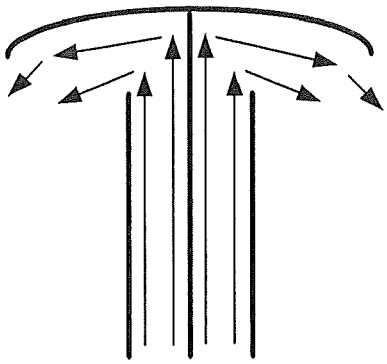
FIGS. 12A-B are diagrams illustrating a plurality of nozzles in an exemplary embodiment of the present invention.
Figure 12B:
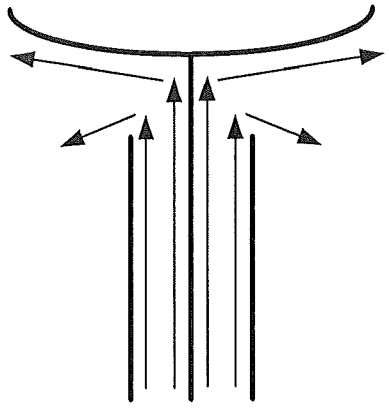

In some embodiments, the plate may be angled to control the spray thickness in some way. For example, a curved plate might be formed that allows for a 360 degree spray of paint but lessens the thickness of the stream by directing the paint partially back toward the exit point 1046. Other plate configurations can include a plate angled out to allow for a thicker spray, a plate angled inward to provide for a thinner spray or curved inward or outward to direct the paint spray. For example, FIG. 11A illustrates an example with a top plate that bends toward the stream, while FIG. 11B illustrates an example with a top plate that bends away from the stream. FIG. 12A illustrates an example with a top plate that curves toward the stream, while FIG. 12B illustrates an example with a top plate that curves away from the stream. These plates are part of the nozzle and should not be confused with the masks 104 and 106.

While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

What is claimed is:

1. A method of painting, the method comprising the steps of:

placing a first masking apparatus inside a hole on a golf course;

placing a second masking apparatus over the hole on a golf course;

locating a paint spraying apparatus between the first and second masking apparatus;

providing a paint dispensing portion having unobstructed access to adjacent soil to be painted wherein the paint dispensing portion simultaneously sprays all of the soil in the golf hole above the golf cup and below the golf green; and simultaneously painting all of the soil in the hole between the first and second masking apparatus.

2. The method of claim 1, wherein the paint spraying apparatus simultaneously sprays a 360 degree radius.

3. The method of claim 1, wherein the first masking apparatus comprises a golf cup mask, and the second masking apparatus comprises a putting green mask.

4. The method of claim 1, further comprising the step of: rotating the paint spraying apparatus relative to the hole.

5. The method of claim 1, further comprising the step of: providing an aerosol spray can and connecting the aerosol spray can to the paint spraying apparatus.

6. A paint spraying device for painting the soil in a golf hole above a golf cup and below a golf green, comprising:

a first masking apparatus;

a second masking apparatus;

a paint spraying portion, configured between the first and second masking apparatus; and a paint dispensing portion having unobstructed access to adjacent soil to be painted wherein the paint dispensing portion simultaneously sprays all of the soil in the golf hole above the golf cup and below the golf green.

7. The device of claim 6, wherein the paint spraying device sprays in a 360 degree radius simultaneously.

8. The device of claim 6, wherein the paint spraying device includes a golf cup mask.

9. The device of claim 6, wherein the paint spraying device includes a golf green mask.

10. The device of claim 6, wherein the paint dispensing portion rotates relative to the golf hole.

11. A paint spraying device for painting the soil of a golf hole, the device comprising:

a first masking apparatus;

a second masking apparatus;

a paint spraying portion, configured between the first and second masking apparatus whereby the paint spraying portion sprays paint on the soil between the first and second masking apparatus and further wherein said spraying portion is capable of simultaneously spraying a full 360 degrees;

an aerosol spray can connected to the paint spraying apparatus;

wherein the paint spraying portion simultaneously sprays in multiple directions.

12. A paint spraying device for painting the soil of a golf hole, the device comprising:

a first masking apparatus;

a second masking apparatus;

a paint spraying portion, configured between the first and second masking apparatus whereby the paint spraying portion sprays paint on the soil between the first and second masking apparatus and further wherein said spraying portion is capable of simultaneously spraying a full 360 degrees;

an aerosol spray can connected to the paint spraying apparatus;

wherein the paint spraying portion simultaneously sprays a full 360 degree radius.

13. A paint spraying device for painting the soil of a golf hole, the device comprising:

a first masking apparatus;

a second masking apparatus;

a paint spraying portion, configured between the first and second masking apparatus whereby the paint spraying portion sprays paint on the soil between the first and second masking apparatus and further wherein said spraying portion is capable of simultaneously spraying a full 360 degrees;

an aerosol spray can connected to the paint spraying apparatus;

wherein the paint spraying portion comprises at least a nozzle having an exit point to direct the spray of paint and further wherein the nozzle includes multiple individual exit points for the spray.

14. A paint spraying device for painting the soil of a golf hole, the device comprising:

a first masking apparatus;

a second masking apparatus;

a paint spraying portion, configured between the first and second masking apparatus whereby the paint spraying portion sprays paint on the soil between the first and second masking apparatus and further wherein said spraying portion is capable of simultaneously spraying a full 360 degrees;

an aerosol spray can connected to the paint spraying apparatus;

wherein the paint spraying portion comprises at least a nozzle having an exit point to direct the spray of paint and further wherein the nozzle is provided with paint utilizing tubes connecting the paint source with the nozzle.

* * * * *